United States Patent [19]

Chin-Sen

[11] Patent Number: 4,792,135

[45] Date of Patent: Dec. 20, 1988

[54] COMPOUND MULTI-FUNCTION GYM BENCHES

[76] Inventor: Chiu Chin-Sen, 5th Fl., No. 9, Lane 180, Kuang Fu South Road, Taipei, Taiwan

[21] Appl. No.: 81,132

[22] Filed: Aug. 3, 1987

[51] Int. Cl.[4] ..... A63B 21/00

[52] U.S. Cl. ..... 272/134; 272/73; 272/118

[58] Field of Search ..... 272/73, 93, 117, 118, 272/134, 144, 123

[56] References Cited

U.S. PATENT DOCUMENTS

| | | | |
|---|---|---|---|
| 4,112,928 | 9/1978 | Putsch | 272/73 |
| 4,382,596 | 5/1983 | Silberman | 272/118 |
| 4,564,193 | 1/1986 | Stewart | 272/118 |
| 4,569,401 | 2/1986 | Luck | 272/73 |
| 4,606,540 | 8/1986 | Chin-Sen | 272/134 |
| 4,653,751 | 3/1987 | Green | 272/123 |
| 4,700,944 | 10/1987 | Sterba et al. | 272/118 |

FOREIGN PATENT DOCUMENTS 8602848 5/1986 World Int. Prop. O. ..... 272/118

*Primary Examiner*—Richard J. Apley
*Assistant Examiner*—J. Welsh
*Attorney, Agent, or Firm*—Kirschstein, Kirschstein, Ottinger & Israel

[57] ABSTRACT

This compound multi-function gym bench is constructed with a seat frame, a hollow post, a weight post combined with a pushing handle and a T-shaped handle, a frame for pulling rope, and a couple of revolving discs with pedals as its main parts. The hollow post is combined with the seat frame vertically, the weight post can be moved up and down inside the hollow post by moving the pushing handle by hand or by pulling a pulling rope, and the pedals set on the revolving discs under the seat frame can be used for bike pedaling exercise. The T-shaped handle with weight block arms can be used for foot pushing exercise with weight blocks hung on the weight block arms. The pushing handle also has weight block arms for hanging weight blocks for weight lifting exercise.

10 Claims, 13 Drawing Sheets

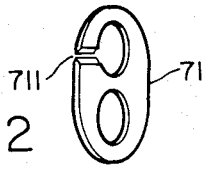
FIG.12
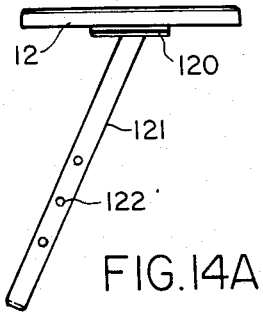
FIG.14A
FIG.15B
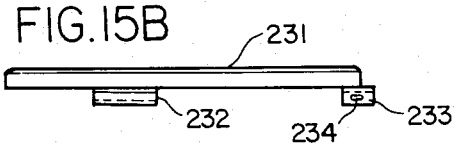
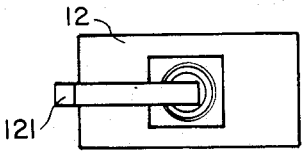
FIG.14B
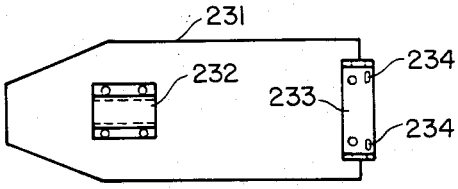
FIG.15A
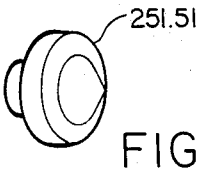
FIG.9
FIG.16A
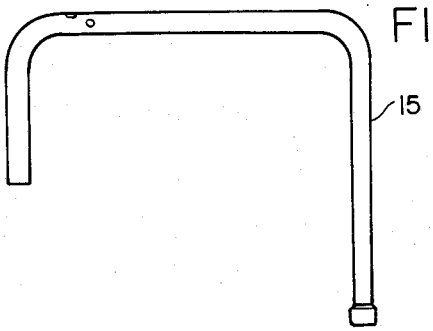
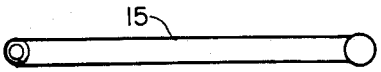
FIG.16B

COMPOUND MULTI-FUNCTION GYM BENCHES

BACKGROUND OF THE INVENTION

Machines or instruments for body or muscle building are generally divided into two kinds, one for a training center and the other for homes. The former are rather complicated and are equipped with various functions in one machine for many persons to use; the latter are mostly constructed for only one function in one machine or instrument to fit in the home environment.

A person has to get various kinds of machines or instruments in order to obtain balanced training for every part of his body. Then these machines or instruments may occupy not a little room or space in the house, and cost a great deal as well. Hence, it is desirable if personal gym machines or instruments would have multi-functions, a compact construction, and occupy little space if they could be broadly used by private persons at home.

SUMMARY OF THE INVENTION

Therefore, the inventor, having engaged in manufacturing gym machines for many years, has worked out this compound multi-function gym bench, which is usable not only at home but at a training center, too. This compact machine can replace common large or single-function ones. By changing the various parts of this bench, a person can use it for bike pedaling exercise, weight lifting or rope pulling either by hand or foot whether in a sitting, lying or standing position.

BTIEF DESCRIPTION OF THE DRAWINGS

FIG. 9 is a view of the sliding wheel in this invention.

FIG. 12 is an enlarged perspective view of the connecting piece for the pulling rope in this invention,.

FIG. 14A is a side view and FIG. 14B is a top view of the seat combined with the elevating rod in this invention.

FIG. 15A is a front view and FIG. 15B is a side view of the leaning cushion in this invention.

FIG. 16A is a front view and FIG. 16B is a side view of the movable foot in this invention.

DETAILED DESCRIPTION OF THE PREFERRED EMBODIMENT

Figure 1:
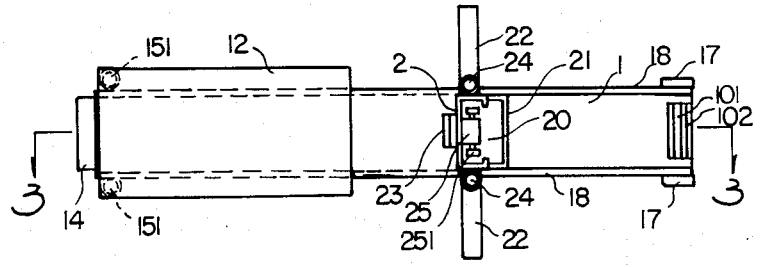
FIG. 1 is a side view of the seat frame combined with the hollow post of the gym bench of this invention.
Figure 2:
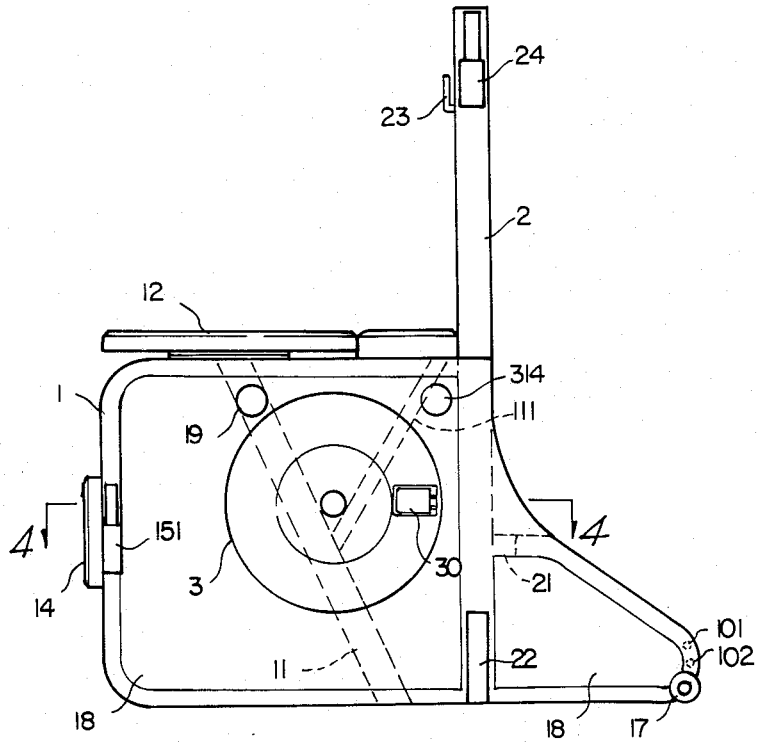
FIG. 2 is a top view of FIG. 1.
Figure 4:
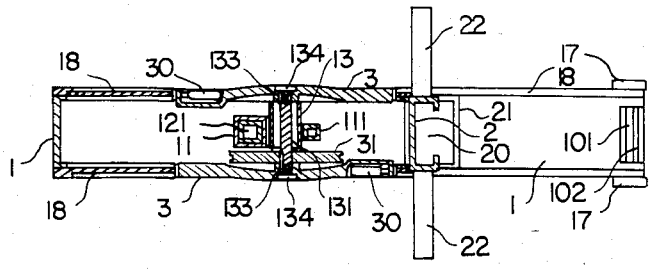
FIG. 4 is a cross-sectional view taken on line 4—4 of FIG. 1.
Figure 3:
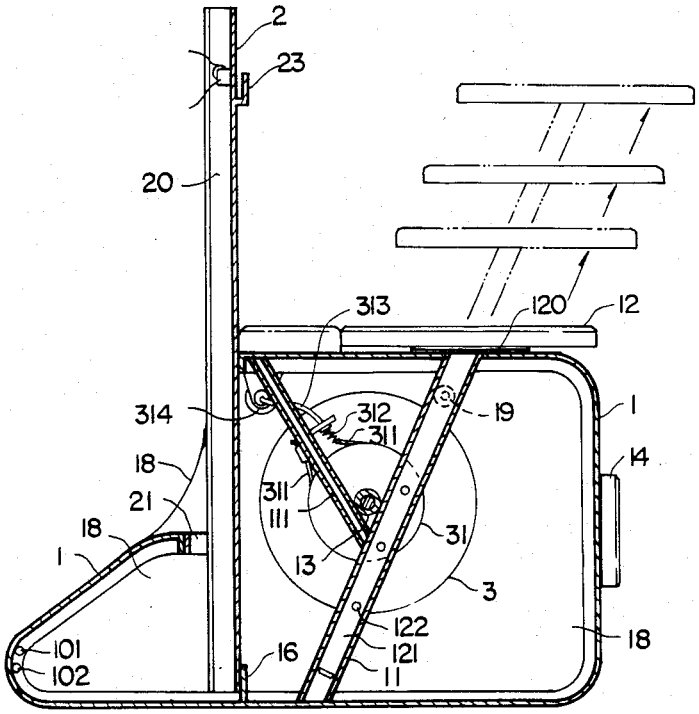
FIG. 3 is a cross-sectional view taken on line 3—3 of FIG. 2.

This compound multi-function gym bench comprises seat frame 1, hollow post 2, revolving discs 3, frame for pulling rope 4, weight post 5, weight blocks 6, pulling rope 7, pushing handle 54, and T-shaped handle 56 as its main parts.

As FIGS. 1, 2, 3, 4 show, seat frame 1 includes a bent plate through an upper side of which is bored a square hole. A hollow square rod 11 is welded at the hole and extends slantingly down to a base. A supporting rod 111 is welded at the middle of rod 11 and extends slantingly upward. The lower end of square rod 11 is welded at the base of seat frame 1 so that rod 11 is steady and immovable. Then elevating rod 121 under seat 12 can be inserted and moved up and down in square rod 11. Axle tube 13 is welded on the cross point where square rod 11 crosses with supporting rod 111, and axle 131 is set with bearings 133 for combining with the pedaling parts. Besides, cushion 14 is set at the front of seat frame 1 and at both its sides are welded inserting bars 151 for one end of movable feet 15 to be inserted. Hollow post 2 is vertically combined with the rear of seat frame 1 with screws screwing together the front middle part of post 2 and one end of the plate of seat frame 1. The lower part of post 2 is welded to backward supporting case 21 and then screwed to the other end of the plate of seat frame 1. The lower end of post 2 is screwed to combining plate 16 of the base of seat frame 1. The hollow post 2 is combined together with seat frame 1 at three spots to solidify their structure. Wings 22 are set at both bottom sides of post 2 to strengthen the steadiness of this gym bench. Hanging hook 23 set at the upper part of post 2 is used to hook leaning cushion 231. Inserting bars 24 welded at both sides of the top part of post 2 is for the frame 4 for pulling rope to be inserted to stand upright. Wheels set at both rear bottom sides of seat frame 1 are used for moving this gym bench by tilting and pushing it. Side plates 18 are attached at both sides of seat frame 1 to impart neatness to its outward appearance. Lateral bars 101,102 set at the rear bent end of the plate of seat frame 1 are exposed to be hooked by T-shaped rod 103.

Figure 5:
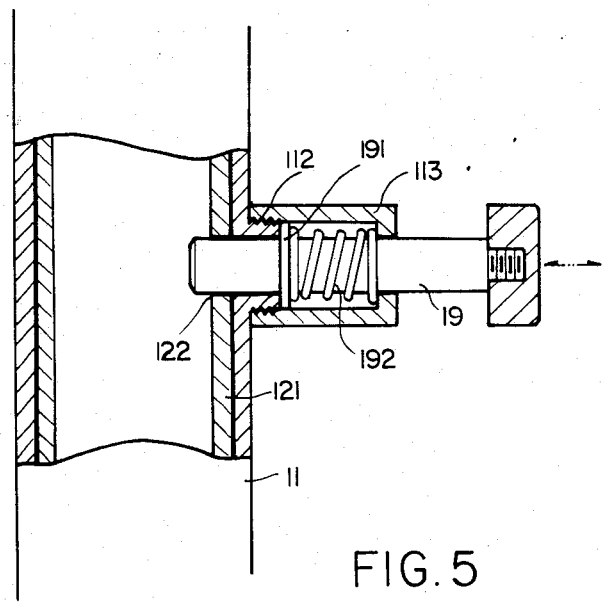
FIG. 5 is a cross-sectional view of the controlling pin for raising up and lowering down the seat in this invention.

As FIG. 5 shows, control pin 19 is used to arrest the position of the elevating rod 121 inside hollow square rod 11. The pin 19 is insertable through a cylinder 113 and a hollow threaded member 112. The cylinder 113 is threaded on the hollow member 112. Stop rings 191 on the control pin 19 engage opposite ends of a spring 192 for pressing the control pin 19 into a hole 122 of elevating rod 121 in stopping and keeping elevating rod 121 at its place. Spring 192 enables control pin 19 to be pulled out of hole 122 for changing the height of seat 12 and adjusting elevating rod 121 up or down along hollow square rod 11.

Figure 7:
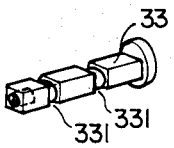
FIG. 7 is a perspective view of the control rod for combining the revolving disc with the pedal in this invention.
Figure 6:
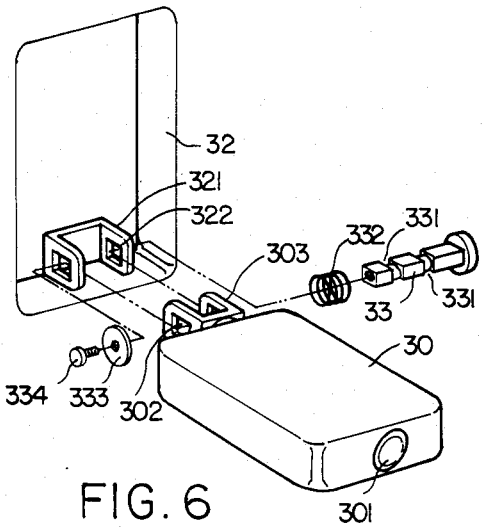
FIG. 6 is an exploded perspective view of how the pedal is to be combined with the revolving disc in this invention.

Revolving discs 3 are set at both ends of axle 131 extending out of axle tube 13 by means of square pin 133 and a screw 134. Friction wheel 31 set between one of revolving discs 3 and axle tube 13 turns around with axle 131 and friction band 311 trained around friction wheel 31 functions to adjust mutual frictional force, and also to adjust the revolving force of both revolving discs 3 that revolves together with axle 131. One end of friction band 311 is attached on supporting rod 111 and the other is connected control button 314 by means of spring 312 and rope 313. Turning control button 314 can change the tautness of friction band 311 against friction wheel 31. But this art is well known, so its detailed description is omitted. The revolution of revolving discs 3 is effected by pedals 30 shown in FIG. 6. Pedals 30 can be pushed up and stored in concave recesses 32 in revolving discs 3, in which a couple of combining ears 321 are set to connect pedals 30 by means of square holes 322 which coincide with square holes 302 of combining ears 303 of axle 301. Square control rod 33 is laterally inserted through aligned holes 322, 302. Said control rod 33 shown in FIGS. 6, 7 is a square rod cut with two ring grooves 331, whose distance between is just the same as that of two combining ears 303 of axle 301. Besides, spring 332 is put at one end of control rod 33 and screw 334 with washer 333 is set at the other end to combine control rod 33 with pedal 30 so that pedal 30 can be pulled down or pushed up into concave recess 32.

Figure 8:
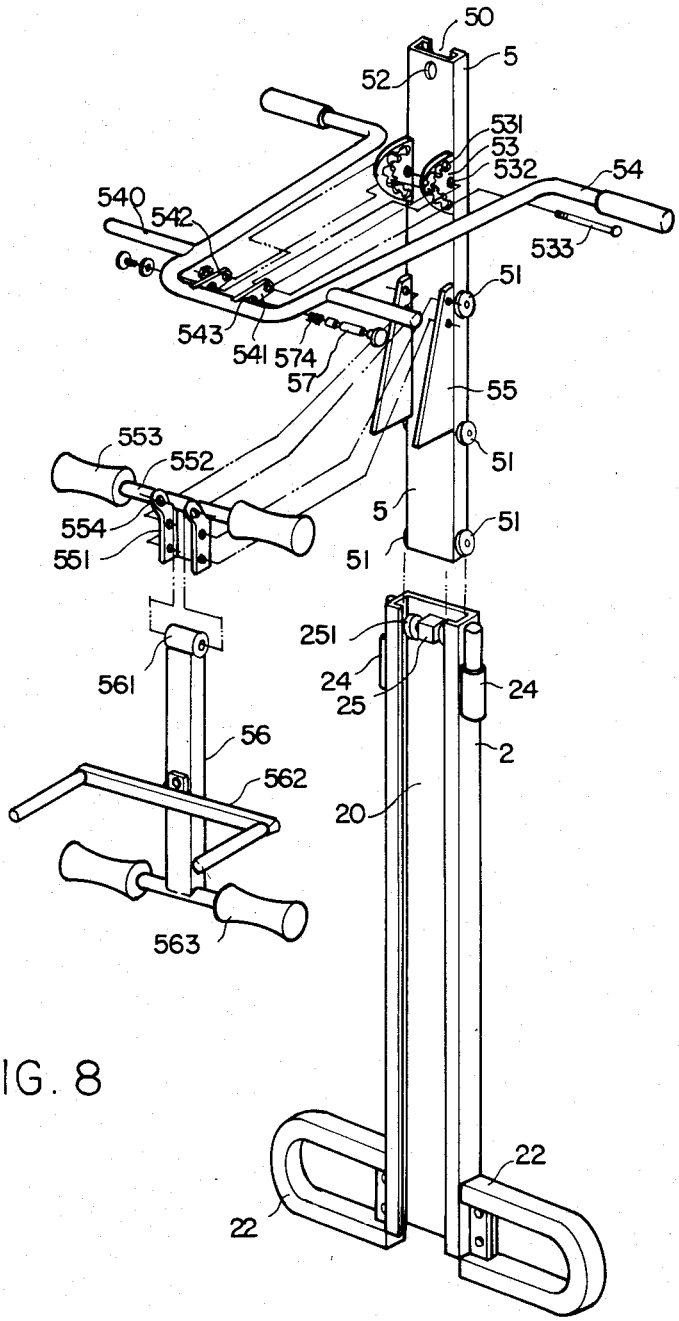
FIG. 8 is an exploded perspective view of the weight post combined with the T-shaped handle and the hollow post in this invention.
Figure 18:
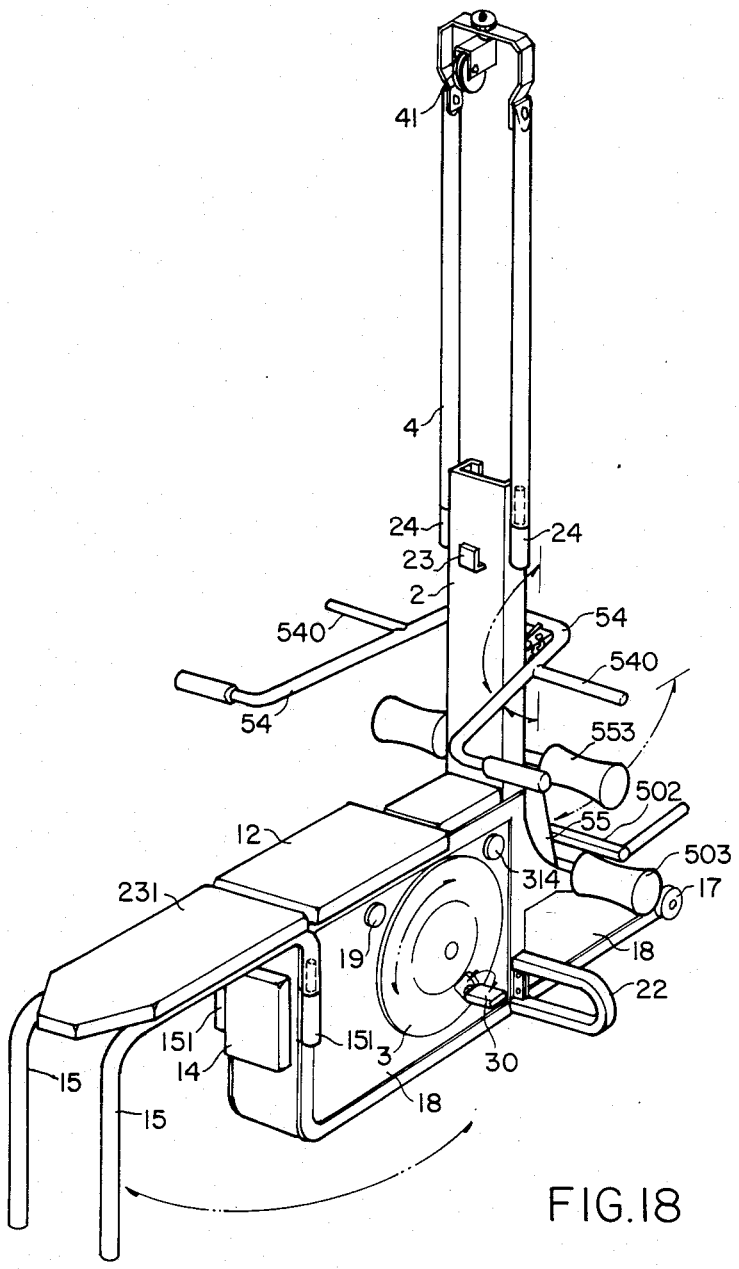
FIG. 18 is a rear perspective view of this gym bench additionally attached with the frame for pulling rope in this invention.

As FIG. 8 shows, hollow post 2 cut with lengthwise opening 20 stands vertically on the ground, and weight post 5 combines with post 2 and is able to slide up and down inside post 2 by means of wheels 251 attached with wheel seat 25. Two inserting bars 24 are set at both upper sides of post 2 for frame for pulling rope 4 to insert in. Frame for pulling rope 4, as FIG. 18 shows, has hanging wheel 41 at the top which can change to face forward or backward for pulling rope 7 to be hung on.

Figure 10A:
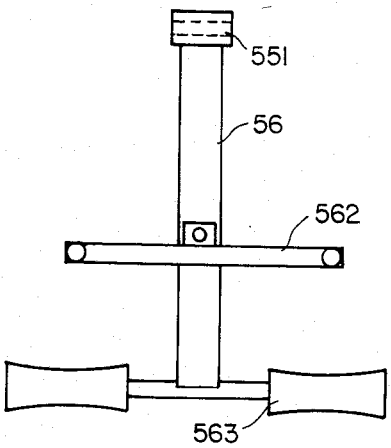
FIG. 10A is a front view and FIG. 10B is a side view of the T-shaped handle in this invention.
Figure 10B:
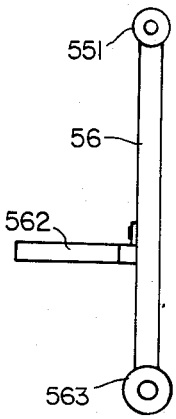

FIG. 8 also shows how weight post 5 is combined with hollow post 2. Weight post 5 has lengthwise opening 50 and is to be inserted from above into the inside of post 2 with its rear exposed out through opening 20. The position of weight post 5 is to be changed and stabilized inside post 2 by sliding wheels 251 and three pairs of sliding wheels 51 set on both sides of weight post 5. Sliding wheels 251, 51 are shaped, as FIG. 9 shows, conical at its outside to reduce lateral friction during their gliding movement up and down. Weight post 5 has an upper hanging hole 52 to be hooked by one end of pulling rope 7, and a pair of semi-circle combining plates 53 set at both sides below hanging hole 52 for combining pushing handle 54 so that handle 54 can be adjusted and used in different angles. Moreover, a couple of triangular plates 55 are set on both sides of weight post 5 for fixing two guiding plates 551, which are fixed with lateral rod 552 with soft cushions 553 at both its ends and have a combining hole 554 for connecting T-shaped handle 56 for leg exercise shown in FIGS. 8, 10A, 10B. T-shaped handle 56 has axle tube 561 for an axle to insert through in combining with guiding plate 551 inserting through combining holes 554 at the same time. Weight block arm 562 can be put on or taken down at the middle of T-shaped handle 56 for loading weight blocks 6. Soft cushions 563 are attached at both ends of the lateral bar of T-shaped handle 56 for feet to step on.

Figure 11:
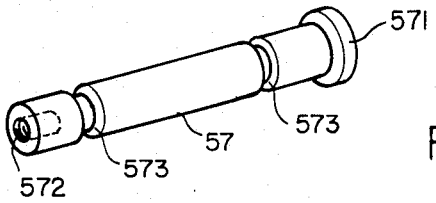
FIG. 11 is an enlarged perspective view of the control rod for the pushing handle in this invention.

In order to combine pushing handle 54 with two combining plates 53 of weight post 5, a plurality of matching holes are connected by guiding slot 531. Axle 533 is inserted through axle holes 532 of combining plates 53 and axle holes 542 of parallel arms 541 set on pushing handle 54. Control rod 57 is inserted through one of matching holes of combining plates 53 and holes 543 of parallel arms 541. As shown in FIGS. 8, 11, the one end of control rod 57 becomes rod head 571 and the other end is bored with inside screw hole 572, and ring grooves 573 are cut at the same distance as between two combining plates 53. Spring 574 is put around control rod 57 near rod head 571 to stabilize parallel arms 57 against combining plates 53 by not coinciding ring grooves with guiding slot 531 of combining plates 53, but coinciding ring grooves 573 with guiding slot 531. This enables control arm 57 to move along guiding slot 531 and consequently the angle of pushing handle 54 can be selected as needed.

Weight block arms 540 are set extending out of the U-shaped part of pushing handle 54 for hanging weight blocks 6, as shown in FIG. 8.

Pulling rope 7 is made of common wire rope with its one end hooked at hooking hole 52 of weight post 5 and the other end with grip 72 through connecting piece 71. If pulling rope 7 is needed to be extended, it can be done using two connecting pieces. As FIG. 12 shows, connecting piece 71 has slot 711 for slot 711 of another piece 71 to couple with each other.

Figure 13A:
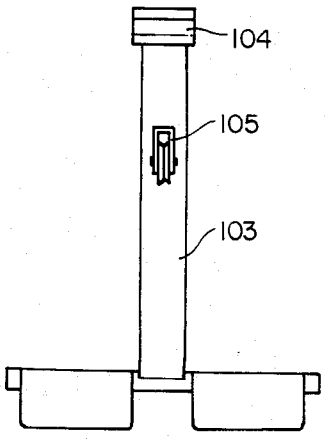
FIG. 13A is a front view and FIG. 13B is a side view of the T-shaped rod in this invention.
Figure 13B:
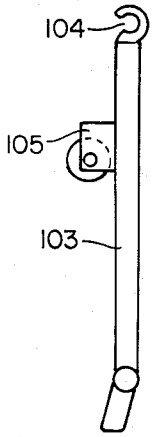

As FIGS. 13A, 13B show, T-shaped rod 103 combined at the rear of seat frame 1 has hook 104 at the top, a lateral rod at the bottom, and wheel 105 set near the middle of the vertical part for pulling rope 7 to be guided. So in combining T-shaped rod 103, hook 104 should be hooked with lateral bar 101 and rested on lateral bar 102.

Seat 12 shown in FIGS. 14A, 14B has revolving base 120 which is able to turn around to any degree (0°–360°). Under revolving base 120 is slantingly fixed elevating rod 121 bored with several holes 122 for adjusting the height of seat 12.

FIGS. 15A, 15B show leaning cushion 231, which is to be hooked on hanging hook 23 of hollow post 2 by means of plate 232 set at the rear lower part of cushion 231. Leaning cushion can also be taken off hollow post 2 and placed on movable feet 15 with screws fixed through holes 234 of combining plate 233 set at one end of cushion 231. Then leaning cushion 231 becomes a long seat connected to seat 12 as FIG. 18 shows.

Movable feet 15 are made up of bent pipes, one end standing on the ground and the other inserted in inserting bars 151 set at both front sides of seat frame 1. FIGS. 16A, 16B show moving feet 15.

Figure 17:
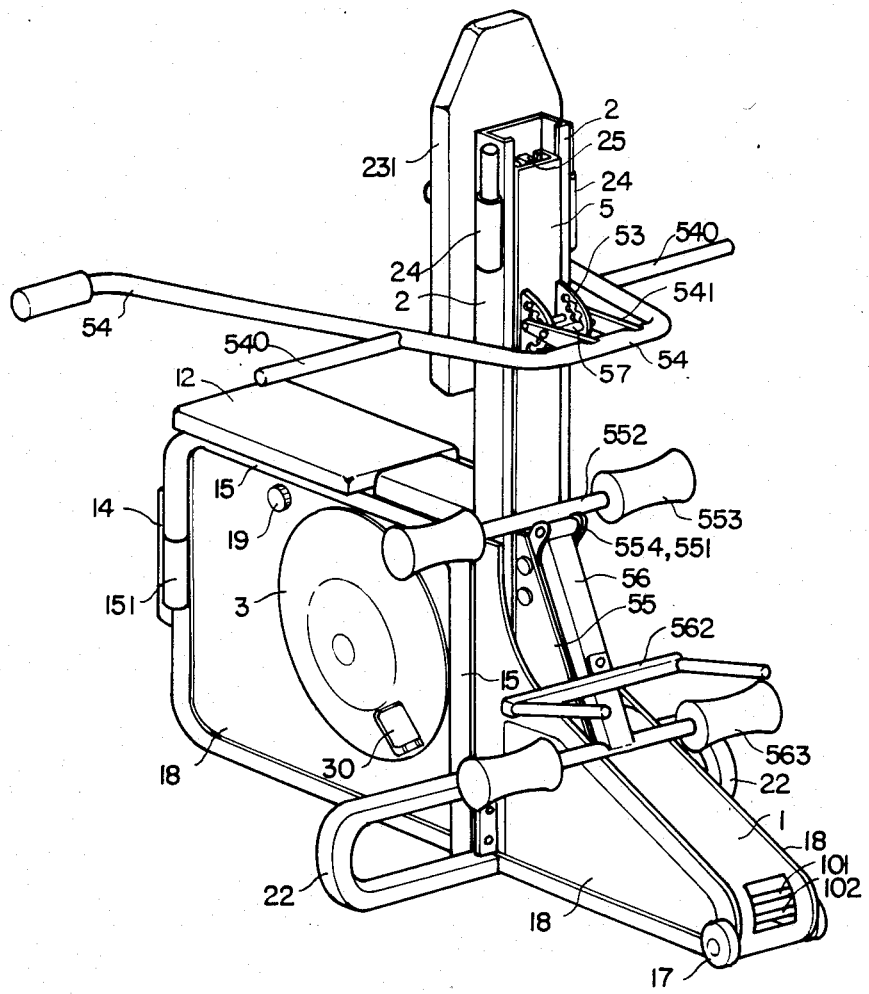
FIG. 17 is a front perspective view of the gym bench in this invention.

Now how to assemble this gym bench for various uses will be described. FIG. 17 shows the fundamental form of this gym bench, wherein weight blocks can be hung on both sides of weight block arm 540 of pushing handle 54, and pushing handle 54 can be adjusted for its using angle by moving control rod 57. Then this bench can be used for weight lifting in a sedentary or lying position. Next, if weight blocks are hung on weight block arm 562 of T-shaped handle 56, this bench can be used for foot pushing by stepping and pushing handle 56, but pushing handle 54 should be changed in its position so as not to disturb the foot exercise.

Figure 19:
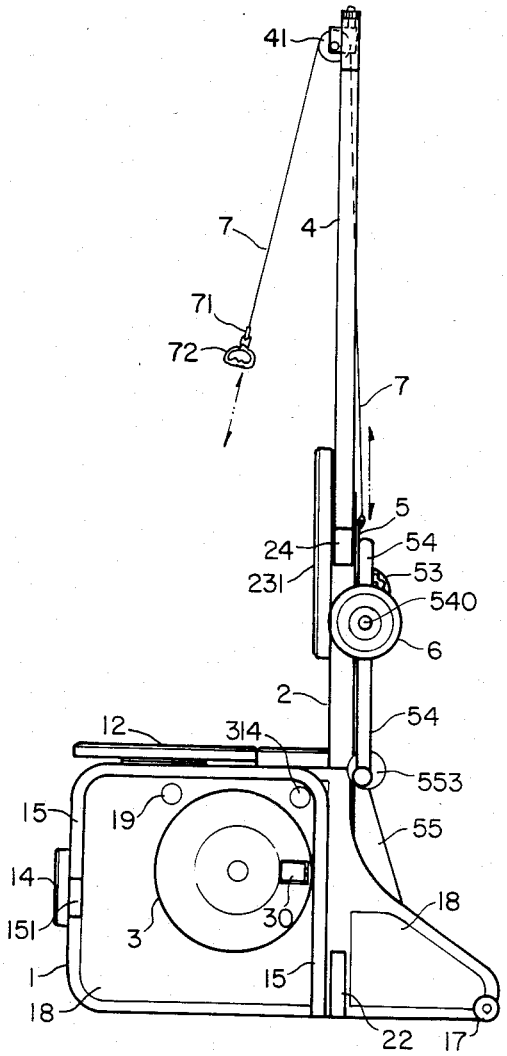
FIG. 19 is a side view depicting the use of the pulling rope in this invention.
Figure 20:
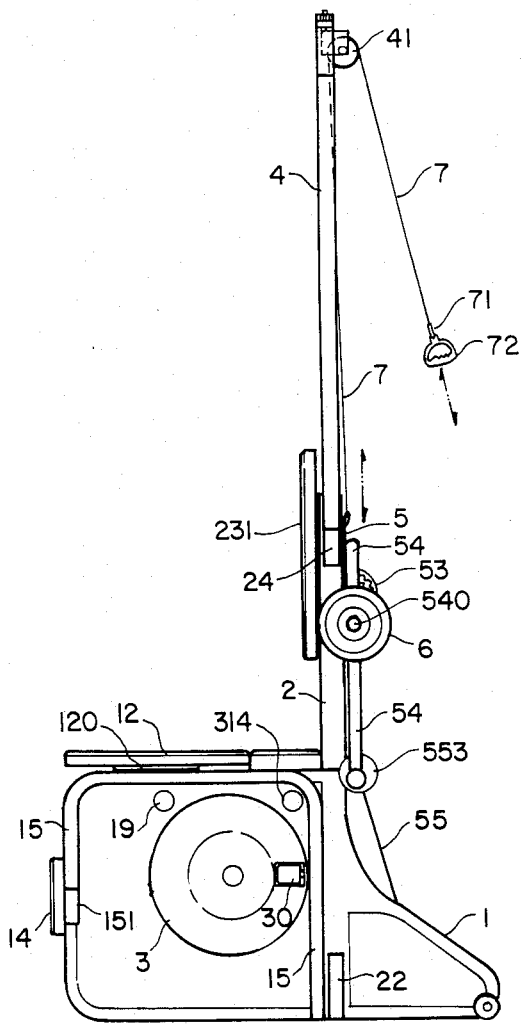
FIG. 20 is a side view depicting another use of the pulling rope in this invention.
Figure 21:
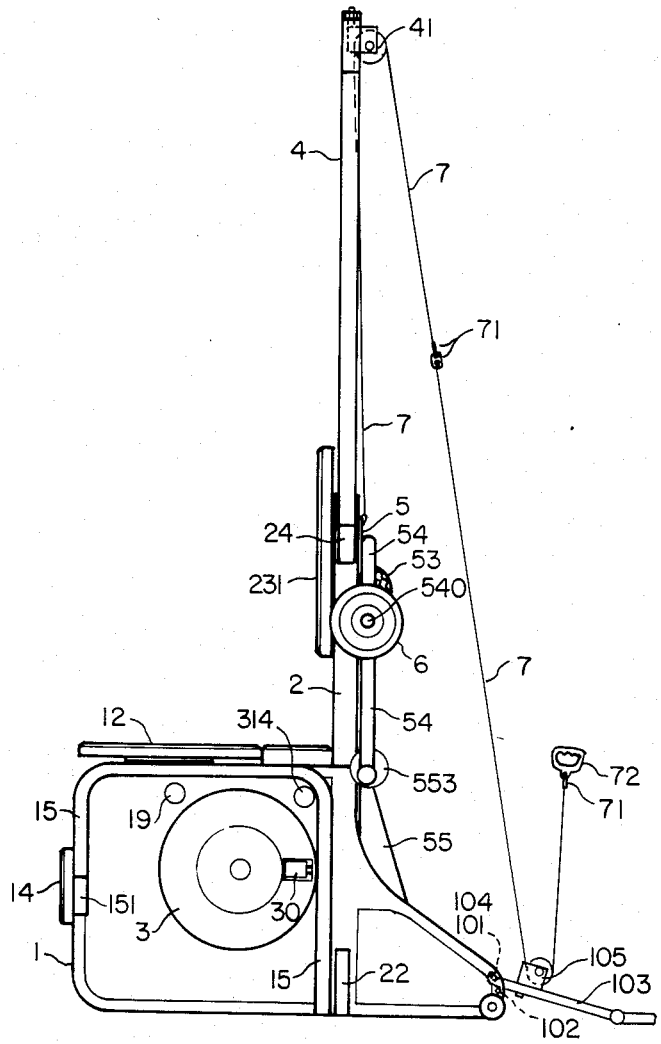
FIG. 21 is a side view depicting the use of pulling rope along with the T-shaped rod in this invention.
Figure 22:
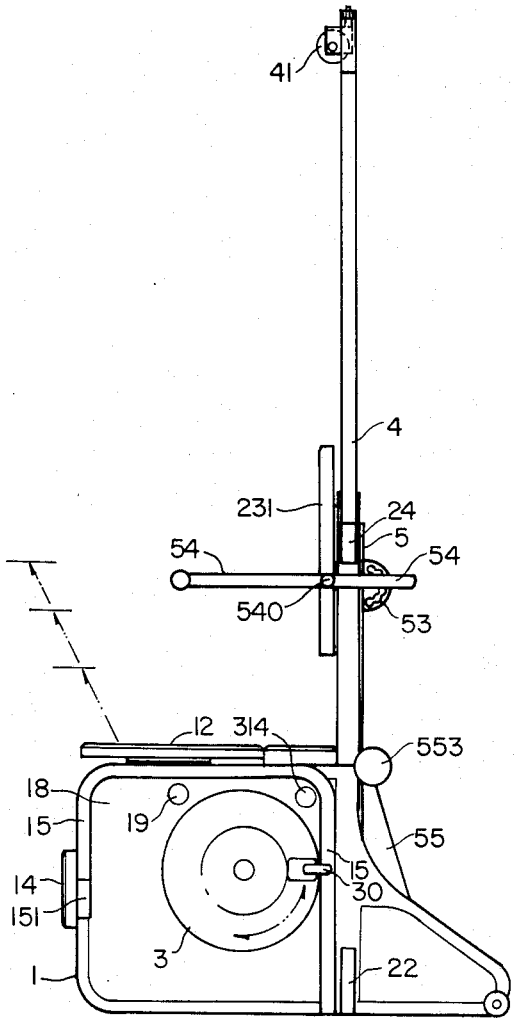
FIG. 22 is a side view depicting the use of the pedals in this invention.

FIG. 18 shows that this gym bench shown in FIG. 17 is assembled with frame for pulling rope 4 and the seat is prolonged as well. FIG. 19 shows this gym bench can then be used for training in pulling down rope 7 at the front. At this situation T-shaped handle 56 can be taken off. FIG. 20 shows this bench is used for training in pulling down rope 7 at the rear. FIG. 21 shows T-shaped rod 103 is added to this bench for pulling up rope 7 with feet stepping on it. FIG. 22 shows the height of seat 12 can be adjusted according to the user's need, and pedals 30 can be pulled down from both sides of revolving discs 3 and the angle of pushing handle 54 can be adjusted for bike pedaling exercise.

In general, this gym bench has compact size, multi-functions in a single unit, easy manipulation in changing its parts, and versatile adaptability in homes or offices or training centers. An actually produced sample has shown that this gym bench possesses higher practical value than other gym machines on the market do.

What is claimed is:

1. A gym set, comprising:

(a) a frame mountable on a support surface;

(b) a seat mounted on the frame for a user to sit on;

(c) means for adjusting the position of the seat relative to the frame;

(d) bicycling means mounted on the frame below the seat for enabling a seated user in adjusted position to perform a bicycling-type exercise, including a main wheel turnable about an axis, resistance means for resisting turning movement of the main wheel, and foot pedals operatively connected to the main wheel for turning the same against the resisting action of the resistance means;

(e) a support column supported by the frame and having walls bounding an upright channel;

(f) a weight column reciprocally movable in and lengthwise along the upright channel; and (g) a handlebar assembly mounted on the weight column for joint movement therewith, said handlebar assembly including weight support holders for supporting a desired quantity of weights, and handlebar arms extending from the weight column to either side of the support column to enable the seated user performing a bicycling-type exercise to grasp the handlebar arms of the handlebar assembly and also lift and lower the weights supported thereon.

2. The gym set according to claim 1, wherein the adjusting means includes an elongated shaft connected to the seat and having a plurality of holes arranged lengthwise of the shaft, and a control pin extending through the frame and insertable into one of said holes; and wherein said shaft is inclined relative to the seat; and wherein said frame mounts the shaft for sliding movement along an inclined direction.

3. The gym set according to claim 1, wherein the adjusting means includes a swivel for enabling the seat to be rotated about an upright axis.

4. The gym set according to claim 1, wherein the main wheel includes a pair of discs mounted on a common axle, each disc having a concave recess, and wherein the bicycling means includes means for mounting the foot pedals for movement between a stowed position in which the pedals are stored in the concave recesses, and a use position in which the pedals are positioned out of the concave recesses.

5. The gym set according to claim 1, wherein the support column includes a planar front wall, a pair of planar side walls extending rearwardly and perpendicularly of the front wall, and a pair of planar rear walls extending toward each other in a plane generally parallel to, and spaced from, the front wall and terminating short of each other to form a rear opening which extends lengthwise along the support column, and wherein the weight column extends in part outwardly of the rear opening; and further comprising a plurality of rollers on the columns and rolling along the upright channel during the reciprocal movement of the weight column.

6. The gym set according to claim 1; and further comprising means for adjusting the angular position of the handlebar assembly relative to the weight column.

7. The gym set according to claim 1; and further comprising a leg-exercising assembly mounted on the weight column for joint movement therewith, said leg-exercising assembly including auxiliary weight support holders for supporting a desired quantity of weights, and feet-engaging members extending from the weight column to either side of the support column to enable the seated user to engage the feet-engaging members and lift and lower the weights supported on the leg-exercising assembly.

8. The gym set according to claim 1; and further comprising a cushion, and means for detachably mounting the cushion on the support column, and additional means for detachably mounting the cushion on the frame adjacent the seat.

9. The gym set according to claim 1; and further comprising a rope pull frame having an overhead pulley; and means for detachably mounting the rope pull frame on the support column; and means for connecting one end of a rope to the weight column, and for guiding the rope about the pulley; and further comprising a handle at the opposite end of the rope to enable the user to grasp the handle and pull and lower the weight column via the rope.

10. The gym set according to claim 9; and further comprising an extension detachably mounted at the rear of the frame, said extension having another pulley about which the rope is entrained.

* * * * *